United States Patent [19]

Nowicki et al.

[11] 4,322,957

[45] Apr. 6, 1982

[54] APPARATUS FOR DRYING OF TUBULAR FABRICS

[75] Inventors: Andrzej N. Nowicki, Melton Mowbray; David H. Smith, Queniborough, both of England

[73] Assignee: Samuel Pegg & Son, Limited, Leicester, England

[21] Appl. No.: 152,157

[22] Filed: May 22, 1980

[30] Foreign Application Priority Data

May 30, 1979 [GB] United Kingdom ..... 18778/79

[51] Int. Cl.[3] ..... D06B 3/28; D06B 15/02; D06B 15/09; D06B 23/04

[52] U.S. Cl. ..... 68/13 R; 68/19.1; 68/20; 68/22 R; 68/177

[58] Field of Search ..... 68/13 R, 19.1, 20, 22 R, 68/177, 178, 179, 181 R, 184; 26/80, 81, 85; 15/40, 102, 306 A; 264/103, 564, 565, 572; 34/70, 105; 226/118, 119

[56] References Cited

U.S. PATENT DOCUMENTS 3,324,486 6/1967 Kurosaki ..... 68/181 R X
3,508,286 4/1970 Rosen ..... 68/22 R X
3,686,905 8/1972 Stanway ..... 68/177 X
3,994,147 11/1976 Dalle et al. ..... 68/178 X
4,155,227 5/1979 Conti ..... 26/81 X
4,182,140 1/1980 Sando et al. ..... 68/181 R X

FOREIGN PATENT DOCUMENTS 535500 11/1955 Italy ..... 68/22 R

*Primary Examiner*—Philip R. Coe
*Attorney, Agent, or Firm*—Cohn, Powell & Hind

[57] ABSTRACT

The invention provides a drying apparatus for a preliminary drying operation for tubular fabrics which includes a pair of drivable squeeze rollers forming a water expression nip, a freely rotatable supply roller resting against one of the squeeze rollers to form a fabric transportation nip, a transverse stretching device and air bubble forming means arranged below the water expression nip, a tube for receiving fabric from the fabric transportation nip at an upper end and a draining surface extending under the transverse stretching device and the lower end of the tube for receiving bundled fabric from the tube for passing to the transverse stretching device, and a means for supplying water to the tube for assisting downward fabric movement through the tube. The apparatus is compact, simple and can be effectively combined with other machinery for a final drying operation.

9 Claims, 4 Drawing Figures

APPARATUS FOR DRYING OF TUBULAR FABRICS

DESCRIPTION

The invention relates to apparatus for drying of tubular fabrics following wet treatments and in particular to apparatus for removing excess water present in interstices of the fabric in a preliminary drying operation prior to drying by hot air in a final drying operation.

The British Patent Specification No. 1,166,018 discloses an apparatus in which an air bubble is inserted in a tubular fabric when it is withdrawn from a bath, the air bubble is restrained by sensing rollers for controlling the size of the air bubble, the fabric is then passed over a transverse stretching device prior to the fabric passing between a pair of squeeze rollers. The fabric is supplied to the bath from a skip by a belt driven roller. This arrangement requires a considerable amount of space and liquor for the bath. The fabric emerges from the bath in a highly saturated condition.

It is the object of the invention to provide a drying apparatus having a simplified arrangement for transporting fabric to a transverse stretching device, which is economic in its use of floor space, is overall of compact construction and/or facilitates integration of a first excess water removing apparatus for a preliminary drying operation with a hot air drying device for a final drying operation.

The invention provides an apparatus for drying tubular fabric including a pair of drivable squeeze rollers forming a water expression nip, a freely rotatable supply roller resting against one of the squeeze rollers to form a fabric transportation nip, a transverse stretching device and air bubble forming means arranged below the water expression nip, a tube for receiving fabric from the fabric transportation nip at an upper end and a draining surface extending under the transverse stretching device and a lower end of the tube for receiving bundled fabric from the tube for passing to the transverse stretching device, and a means for supplying water to the tube for assisting downward fabric movement through the tube.

The fabric is thus transported from the skip to the transverse stretching device merely by the supply roller which is driven by friction and the tube through which water may cascade down to assist fabric movement. No special drives are required for transporting the fabric to the transverse stretching device. The fabric is withdrawn from the draining surface after an opportunity for water to drain from the fabric. The air bubble is confined by squeeze rollers on the top and the fabric itself on the draining surface, the fabric being in a constricted condition after emerging from the tube.

One of the squeeze rollers engages both the bundled fabric and the flattened fabric and effectively slightly overfeeds the bundled fabric passing through the fabric transportation nip compared with the flattened fabric passing through the water expression nip utilising only the squeeze roller drive. The tube and any downward water flow therein facilitate the smooth supply of bundled fabric. The drained fabric condition reduces the weight of water held in the fabric as it passes over the transverse stretching device and may facilitate the stretching of the fabric in a transverse direction whilst still sufficiently permeated with water to seal in the air bubble. Preferably the supply roller is movable into and out of engagement with the said squeeze roller and a guide eye for fabric is mounted for conjoint movement with the supply roller to guide fabric onto the supply roller. The tube assists the downward fabric movement under varying supply conditions.

Whilst the apparatus of the invention is of simple construction it nevertheless provides for ease of fabric transport and reduces strains on the fabric in the course of treatment.

Preferably the tube has a device for introducing water adjacent the top, which device provides an annular gap and a valve is provided for regulating water flow through the gap and conveniently a pump is provided for recirculating water drained from the draining surface to the water introducing device. Thus the water supplied to the tube is recycled so enabling a small amount of water to be used for transporting a considerable weight of fabric. Suitably a guide member is mounted above the draining surface directly below the transverse stretching device, the apparatus being arranged so that the air bubble is free to expand sideways at a level between the squeeze rollers and the draining surface and an electro-optical device controls the introduction of air into the air bubble. In this way the air bubble can be controlled in a simple manner. Preferably a flow of air assists the detachment of the squeezed fabric and one of the squeeze rollers so as to enable fabric to be vertically lowered in a space-saving manner for a subsequent final drying treatment, for example using the apparatus described in the British Patent Specification No. 1,041,051. Hot air from the final drying treatment can be used to assist the detachment.

DRAWINGS

Figure 1:
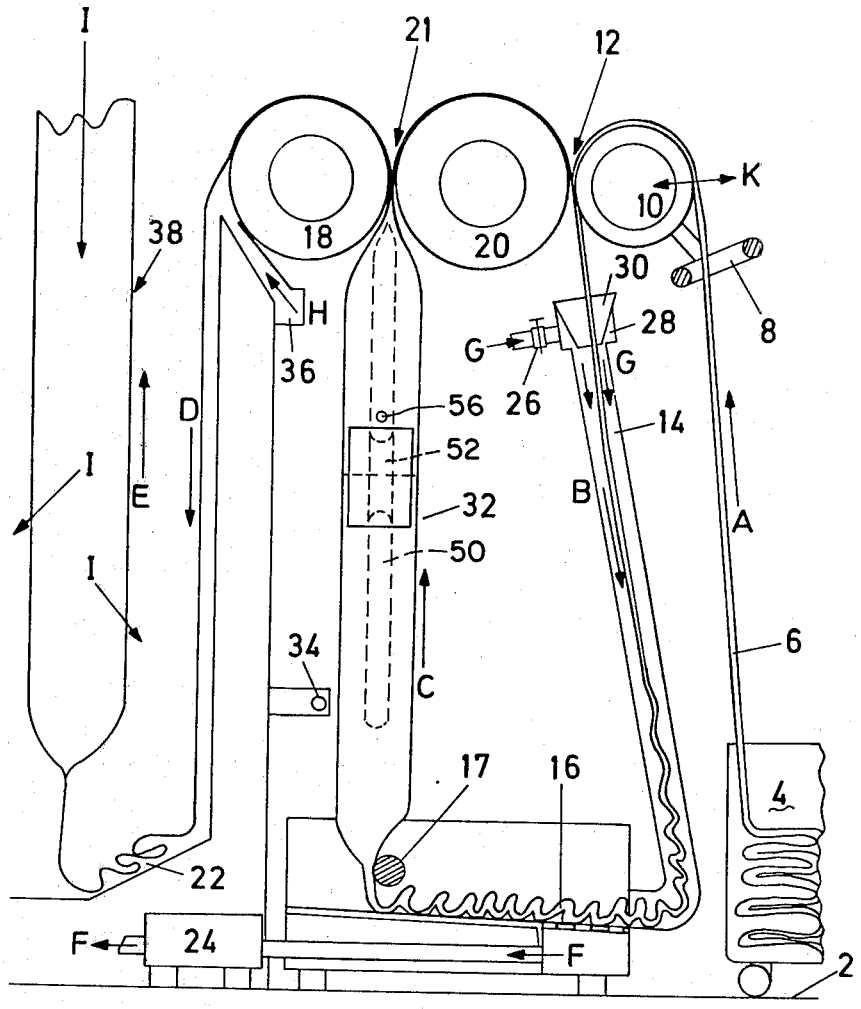
FIG. 1 shows schematically an apparatus for drying tubular fabric according to the invention.
Figure 4:
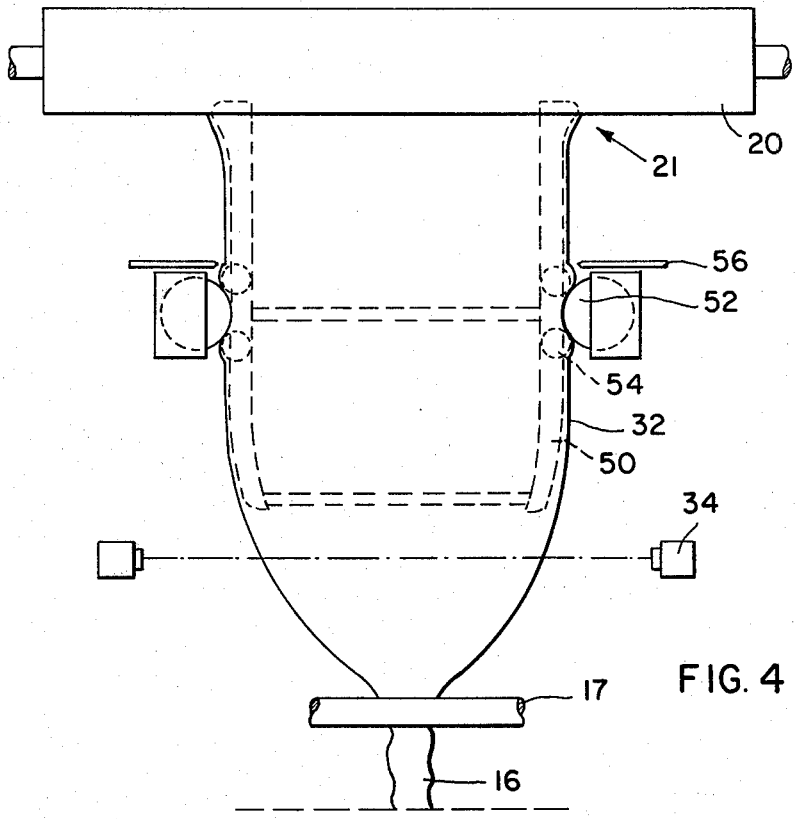
FIG. 4 shows a front view of the apparatus of FIG. 1.

With reference to FIG. 1, an apparatus for drying tubular fabric is mounted on a floor 2 having space for a fabric containing trolley or skip 4 at the front of the apparatus. The skip 4 carries fabric 6, which may previously have undergone a wet finishing or dyeing treatment. The fabric 6 is passed in the direction of arrow A through a circular guide eye 8 and over a rubber covered supply roller 10 downward through a fabric transportation nip 12. The fabric 6 is then guided through a plastics tube 14 (arrow B) in a bundled condition to a draining surface 16 which is in the form of steel sheet inclined upwards away from the tube outlet and perforated adjacent the tube outlet. The fabric 6 is advanced to and passes around a guide rail 17 and hence in the direction of arrow C over a first transverse stretching device, which may be, of the kind described in our British Patent Specification No. 1,041,051 and possess a frame 50 suspended by a profiled external roller 52 which engages a pair of smaller rollers 54 on the frame 50, with the transversely stretched fabric passing between the rollers 52 and 54 (See also FIG. 4). The fabric is then squeezed in the transversely stretched, flat condition between squeeze rollers 18 and 20 in a water expression nip 21 and passed down to a collection surface 22 (arrow D). The fabric 6 is taken up around another transverse stretching device (arrow E) for final drying. The final drying operation may be performed by the apparatus described in our British Patent Specification No. 1,041,051. Water which has passed through the perforated part of the surface 16 is removed by a pump 24 (arrow F). The pump output may be supplied to a valve 26 regulating water flow (arrow G) to a water jetting device 28 with an annular gap formed by a cone 30 for introducing water to the tube 14.

Compressed air can be introduced into the fabric at the transverse stretching device by nozzles (56) in a manner known per se to provide an air bubble inside the fabric at 32. An optical electronic eye 34 can be set to control operation of the nozzles so as to provide proper inflation when the fabric is sufficiently inflated the passage of light to the eye 34 is interrupted, arresting the flow of air out of the nozzles. Water flows down the fabric at 32 by gravity, reducing the amount removed by the squeeze rollers 18, 20.

Hot air from the final drying stage is supplied (arrow H) to the blow device 36 providing a gap extending along the roller 18. Hot air also flows down inside the fabric at 38 and passes through the fabric (arrows I).

Figure 3:
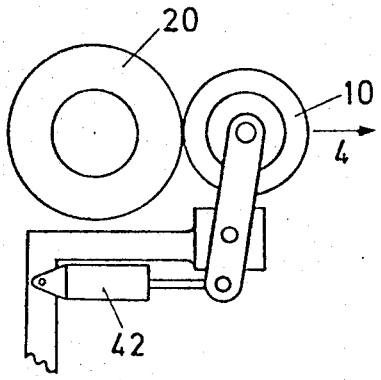
FIG. 3 shows schematically an arrangement for actuating a supply roller.

With reference to FIG. 3, the roller 10 can be pressed against the roller 20 by a double acting pneumatic ram 42 and will in this position cause a small overfeed of fabric compared with the flattened fabric passing through the second nip. If excess amounts of fabric accumulate on the surface 16, the roller 10 can be temporarily detached by applying high pressure air to the other side of the ram 42, causing the roller 10 to move as shown by arrow K, to reduce the amount of fabric supplied.

The guide rail 17 ensures that fabric is always passed to the transverse stretching device in a vertical direction and that the fabric does not accidentally pull the device sideways.

Figure 2:
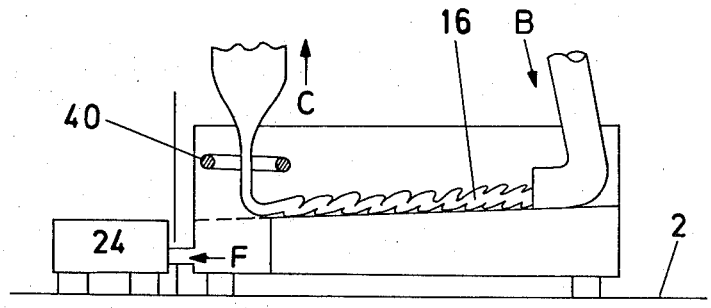
FIG. 2 shows schematically part of a modified apparatus according to the invention.

With reference to FIG. 2, a modified apparatus is as shown in FIG. 1 except for the parts illustrated in FIG. 2. The draining surface 16 slopes downwards away from the tube 14 to a perforated area below the air bubble at 32 and above a sump for the pump 24. The guide rail 17 is replaced by a circular guide ring or loop 40, which not merely prevents accidental tugging of the transverse stretching device at 32 to the right in the Figures but also centers the fabric bundle before it is passed over the transverse stretching device so as to provide good fabric supply conditions.

The apparatus of FIGS. 1 and 2, may be used independently of the final hot air drying apparatus and the blow device 36. Indeed the apparatus of FIGS. 1 and 2 may be used with other fabric treatments intervening before a final drying operation.

We claim:

1. An apparatus for drying tubular fabric including a pair of drivable squeeze rollers forming a water expression nip, a freely rotatable supply roller resting against one of the squeeze rollers to form a fabric transportation nip, a transverse stretching device and air bubble forming means arranged below the water expression nip, a tube for receiving fabric from the fabric transportation nip at an upper end and a draining surface extending under the transverse stretching device and the lower end of the tube for receiving bundled fabric from the tube for passing to the transverse stretching device, and a means for supplying water to the tube for assisting downward fabric movement through the tube.

2. Apparatus as claimed in claim 1 wherein means are provided for moving the supply roller into and out of engagement with the said squeeze roller.

3. Apparatus according to claim 2 wherein a guide eye for fabric is mounted for conjoint movement with the supply roller upstream of the supply roller to guide fabric onto the supply roller.

4. Apparatus as claimed in claim 1 wherein the tube has a device for introducing water adjacent the top, which device provides an annular gap and a valve is provided for regulating water flow through the gap.

5. Apparatus as claimed in claim 4 wherein a pump is provided for recirculating water drained from the draining surface to the water introducing device.

6. Apparatus as claimed in claim 1 wherein a guide member is mounted above the draining surface directly below the transverse stretching device, the apparatus being arranged so that the air bubble is free to expand sideways at a level between the squeeze rollers and the draining surface and an electro-optical device controls the introduction of air into the air bubble.

7. Apparatus as claimed in claim 1 wherein a means for providing a flow of air is arranged for detaching fabric from the other one of said squeeze rollers so as to permit the fabric to pass substantially vertically downward onto a fabric collection surface.

8. Apparatus as claimed in claim 7 wherein there is further provided a hot air drying device for receiving fabric from the fabric collection surface and the means for providing a detaching flow of air is arranged to receive air diverted from the hot air drying device.

9. Apparatus for drying tubular fabric including a pair of drivable squeeze rollers forming a water expression nip, a freely rotatable supply roller for resting against one of the squeeze rollers to form a fabric transportation nip, means for moving the guide roller into and out of engagement with the said squeeze roller, a transverse stretching device and an air bubble forming means arranged below the water expression nip, a sensing device for controlling the introduction of air and thereby the size of the air bubble inside the fabric, a tube for receiving bundled fabric from fabric transportation nip at an upper end, a draining surface extending under the transverse stretching device and a lower end of the tube for receiving bundled fabric from the tube for passing to the transverse stretching device, a guide member mounted above the draining surface directly below the transverse stretching device for guiding fabric from the draining surface onto the transverse stretching device and a means for supplying water collected from the draining surface to the tube for assisting downward fabric movement through the tube.

* * * * *